US005195283A

United States Patent [19]

MacLeod et al.

[11] Patent Number: 5,195,283

[45] Date of Patent: Mar. 23, 1993

[54] SOFFIT VENT AND BRACKET

[75] Inventors: Richard J. MacLeod, Milford; Charles E. Schiedegger, Metamora; Jack G. Wnuk, Lapeer, all of Mich.

[73] Assignee: Mid-America Building Products Corporation, Plymouth, Mich.

[21] Appl. No.: 785,495

[22] Filed: Oct. 31, 1991

[51] Int. Cl.[5] ..... F24F 13/18

[52] U.S. Cl. ..... 52/95; 52/303

[58] Field of Search ..... 52/94, 95, 96, 303

[56] References Cited

U.S. PATENT DOCUMENTS

| | | | |
|---|---|---|---|
| 2,896,559 | 7/1959 | Stephens | 52/94 |
| 3,181,275 | 5/1965 | Schroter et al. | 52/94 |
| 3,204,374 | 9/1965 | Hellekson | 52/94 |
| 3,344,566 | 10/1967 | Miles et al. | 52/94 |
| 4,189,878 | 2/1980 | Fitzgerald | 52/94 |
| 4,285,175 | 8/1981 | Struben et al. | 52/96 |
| 4,347,691 | 9/1982 | Lloyd-Jones | 52/95 |
| 4,461,128 | 7/1984 | Knoebl | 52/94 |
| 4,580,374 | 4/1986 | Quinnell | 52/95 |
| 4,819,390 | 4/1989 | Capper et al. | 52/95 |

*Primary Examiner*—Carl D. Friedman
*Assistant Examiner*—Michele A. Van Patten
*Attorney, Agent, or Firm*—Barnes, Kisselle, Raisch, Choate, Whittemore & Hulbert

[57] ABSTRACT

A combined soffit vent and bracket that includes a one piece plastic extrusion with an end wall adapted to be attached to an outside wall of a house with an integral vent panel having vent openings provided therein and extending substantially perpendicularly from the end wall and a bracket integral with the vent panel which defines an open channel to receive a soffit.

10 Claims, 3 Drawing Sheets

SOFFIT VENT AND BRACKET

BACKGROUND OF THE INVENTION

This invention relates to the building industry, and more particularly, to a soffit vent and bracket A soffit is used to cover an underside of an eave in a house and is held in place by J-brackets well known in the industry. The J-brackets are attached to either a fascia board and/or an outside wall of the house. Solid vinyl or aluminum panels or perforated vinyl or aluminum panels may be used. Perforated soffits provide ventilation, helping to reduce heat buildup in the summer and formation of ice buildup in the winter. If the soffit panel lacks or has inadequate vent openings, perforations must be drilled or cut to provide adequate ventilation. This process is time consuming and increases the installation time as well as causing a waste of material.

The above mentioned problems are overcome by the present invention which provides a combined soffit vent and bracket for holding a soffit and which has venting holes provided in a vent panel integral with the bracket adapted to be attached to an outside wall of a house. The combined soffit vent and bracket also includes an integral lip adapted to receive vinyl or aluminum siding.

BRIEF DESCRIPTION OF THE DRAWINGS

FIG. 3. 7 is a view taken along line 7—7 in FIG. 6.

DESCRIPTION OF THE DRAWINGS

Figure 1:
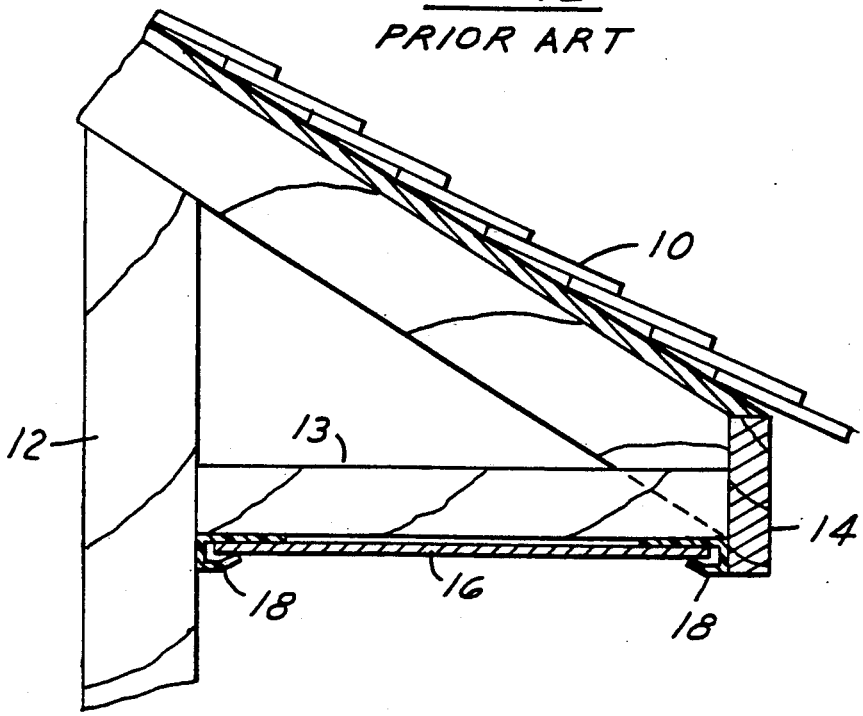
FIG. 1 PRIOR ART
FIG. 1 shows conventional soffit secured by two J-brackets.

FIG. 1 shows a conventional soffit 16 mounted underneath the eave of roof 10 by conventional metal or vinyl J-brackets or channels 18 attached each one to board 13, fascia board 14 and the outside wall 12 of a house. If the soffit lacks or has inadequate ventilation, holes or perforations must be cut in the soffit 16 in order to vent the eave to the outside to prevent heat buildup in the summer and the formation of ice in the winter.

Figure 1A:
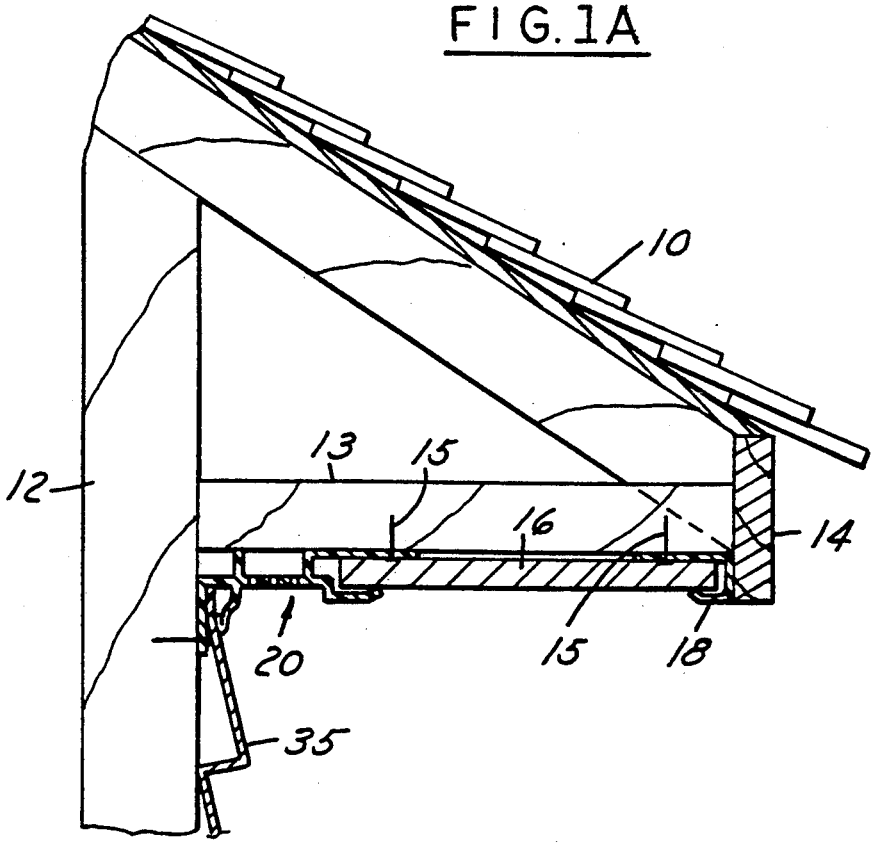
FIG. 1*a* is a cross sectional view of a soffit mounted at one end with a preferred form of the combined soffit vent and bracket
Figure 3:
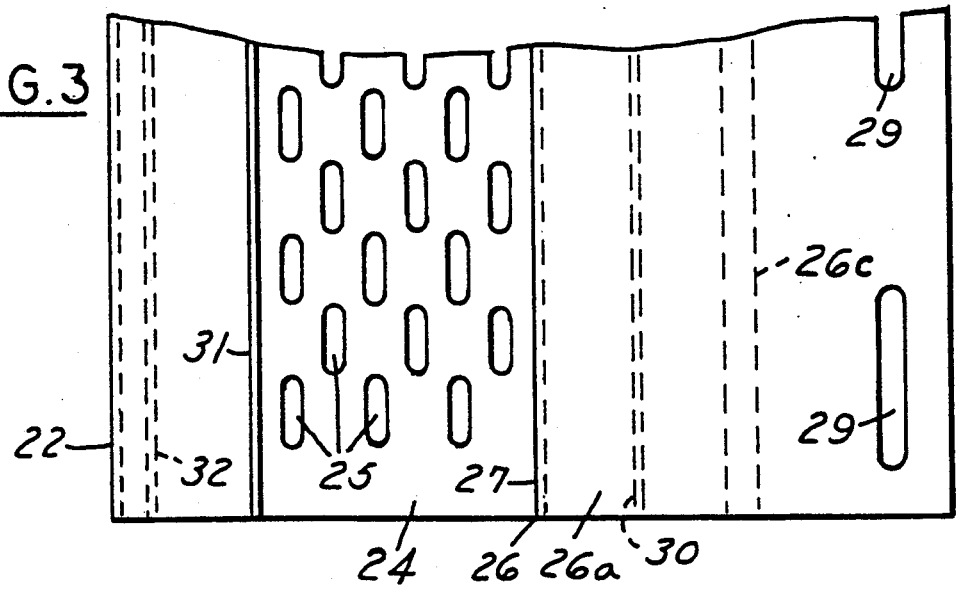
FIG. 3 is a top view taken along line 3—3 in FIG. 2.
Figure 2:
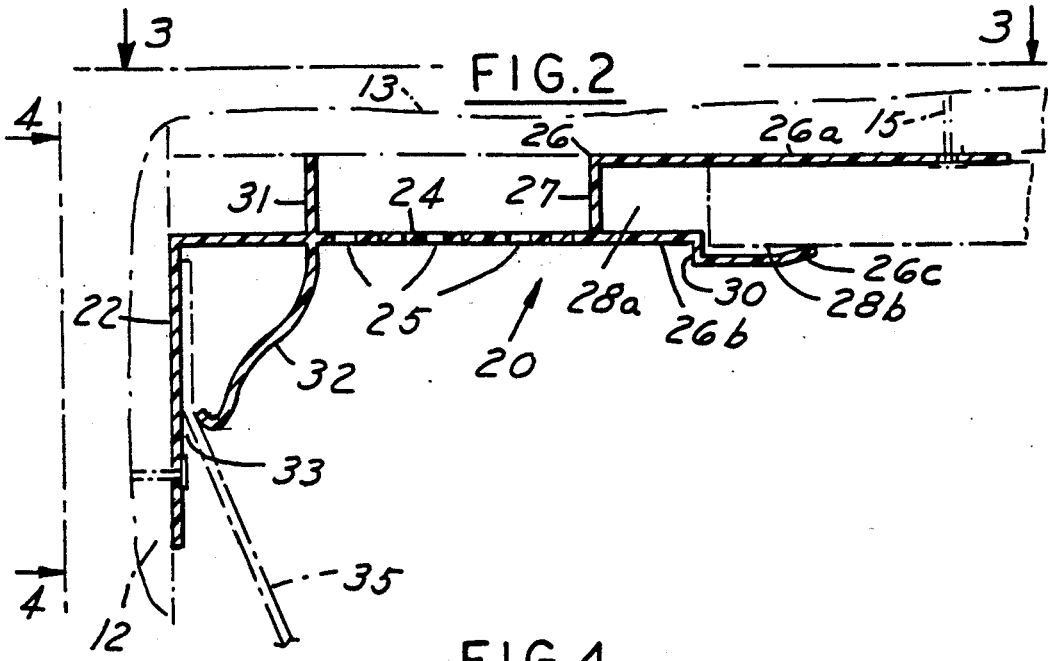
FIG. 2 is an enlarged cross sectional view of the preferred embodiment.

FIG. 1*a* shows a soffit 16 mounted at one end to the fascia board 14 by conventional J-bracket 18 and mounted at the other end by a combined soffit vent and bracket 20 of the first embodiment seen more clearly in FIG. 2. Each bracket 18, 20 is also secured to board 13 by fasteners, such as, for example nails 15. The combined soffit vent and bracket of the first embodiment is made of a plastic one piece extrusion with an end wall 22 adapted to be mounted to an outside wall 12 of the house. Integral with and extending perpendicular thereto is a vent panel 24 with perforated vent openings therein As seen in FIG. 2 and more particularly in FIG. 3, the vent openings are made of a plurality of holes 25 formed through the vent panel. Bracket 26 is integral with the vent panel 24 and is composed of generally parallel walls 26*a*, 26*b* extending from an integral: upstanding wall 27. The walls 26*a*, 26*b* form a channel having at least two widths formed by a step 30 in wall 26*b*. The first narrow width 28*a* is adapted to receive a thin soffit. The wider 28*b* formed by the step 30 in wall 26*b* is adapted to receive a wider soffit as seen in phantom in FIG. 2. Each soffit is securely held to the bracket by upturned end 26*c* on wall 26*b*.

Figure 4:
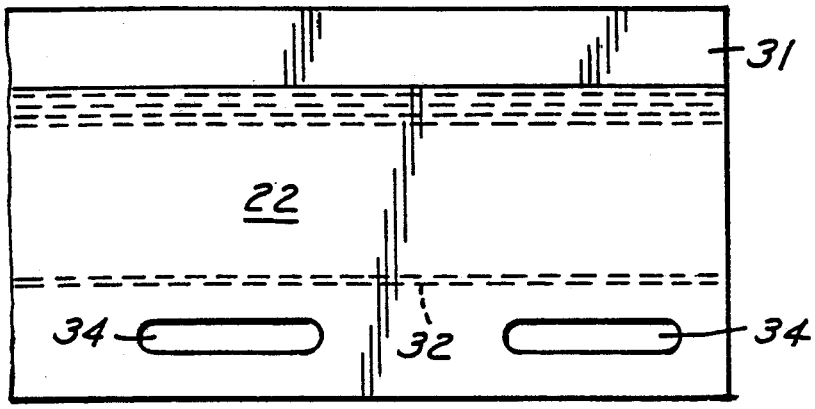
FIG. 4 is an end view taken along line 4—4 in FIG. 2.
Figure 5:
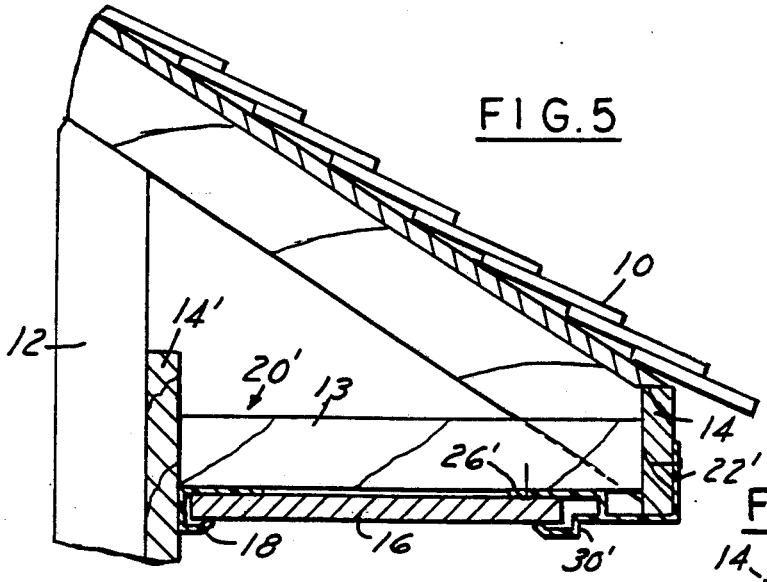
FIG. 5 is a cross sectional view of a soffit mounted with a second form of the invention.
Figure 6:
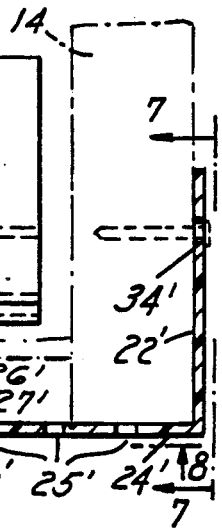
FIG. 6 is an enlarged cross sectional view of a second embodiment.

An angular lip 32 extends downwardly from the bottom of the soffit vent toward the end wall 22 leaving a small gap 33 adapted to receive siding 35 to cover the outside wall 12 of the house. Adjacent the angular extending lip of the opposite side of the vent panel, an upwardly extending short vertical wall 31 provides rigidity to support board 13 and assists in locating the board 13 against the outside wall 12 of the house. In order to secure the end wall 22 against the wall 12, nail holes 34 are provided to receive a fastener such as a nail as seen in FIG. 2 and 4.

Figure 7:
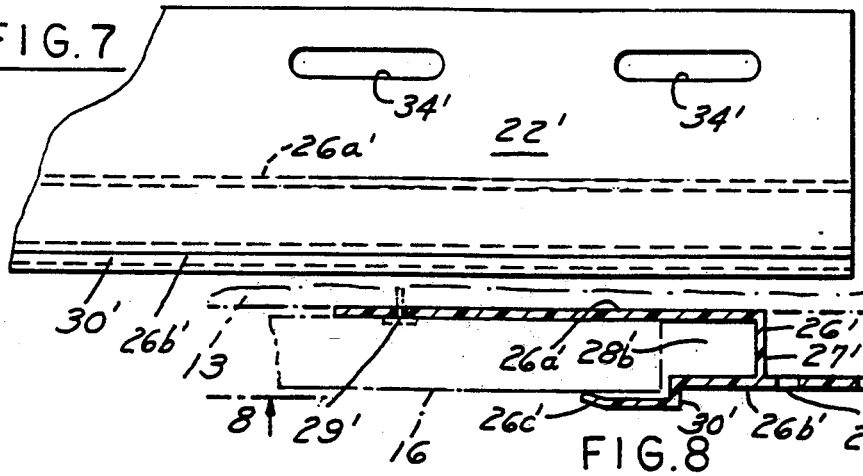
Figure 8:
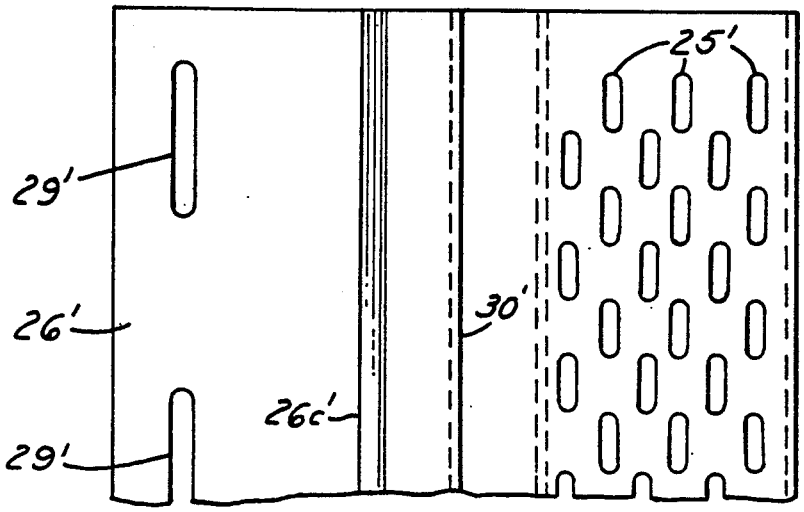
FIG. 8 is a bottom view taken along line 8—8 in FIG. 6

FIGS. 5–8 show another embodiment in the invention. In this embodiment, like numerals will be used for similar parts. End wall 22′ extends vertically upwardly from the vent panel 24′ and is mounted to an outside surface of the fascia board 14 by fasteners such as a nail extending through holes 34′ as seen in FIG. 7.

Similar to the first embodiment, vent panel 24′ contains venting openings 25′ extending therethrough to vent the eave. Integral with the vent panel is bracket 26′ having two substantially parallel side walls 26*a*′, 26*b*′ connected by an upstanding end wall 27′. Side wall 26*b*′ has a step 30′ to form a channel having a narrow width 28*a*′ to receive a thin soffit and a wider portion 28*b*′ to receive a wider soffit Again, wall 26*a*′ is secured to board 13 by fasteners extending through holes 29′ seen in FIG. 8.

Accordingly, the present invention overcomes installation problems of prior devices by providing both quick and easy support for a soffit as well as providing ventilation without having to modify the soffit.

We claim:

1. A combined soffit vent and bracket comprising, a one piece plastic extrusion having an end wall adapted to be attached to one of a fascia board and an outside wall of a house and extend generally vertically, a vent panel integral with and extending substantially perpendicularly from said end wall, vent means provided in said vent panel, and a bracket integral with said vent panel defining an open channel facing away from said end wall for receiving one end of a soffit, said vent panel with vent means therein being located between said end wall and said bracket.

2. A combined soffit vent and bracket as recited in claim 1 wherein said channel has two portions of differing widths to accommodate soffits of varying thickness.

3. A combined soffit vent and bracket as in claim 2 wherein said channel is formed by two substantially parallel horizontal walls connected by a vertical bracket wall, a step provided in one of said horizontal walls defining said portions of differing widths to accommodate soffits of varying widths.

4. A combined soffit vent and bracket as in claim 1 wherein said end wall extends vertically downward from one end of said vent panel.

5. A combined soffit vent and bracket as in claim 3 further comprising an angular lip adjacent said end wall extending downwardly from said vent panel toward said end wall for receiving wall siding therebetween.

6. A combined soffit vent and bracket as in claim 3 further comprising a short vertical wall adjacent said end wall extending upwardly from said vent panel and parallel to said end wall.

7. A combined soffit vent and bracket as in claim 1 wherein said end wall extends vertically upward from one end of said vent panel.

8. A combined soffit vent and bracket as in claim 1 further comprising nail holes provided in said end wall and said bracket.

9. A combined soffit and bracket as in claim 1 wherein said vent means comprise a plurality of holes through said vent panel.

10. A combined soffit vent and bracket as recited in any one of claims 1-9 further including a soffit and means for connecting an opposite end of said soffit to one of said fascia board and said house.

* * * * *